United States Patent [19]

Litehizer, Jr.

[11] 4,286,381

[45] Sep. 1, 1981

[54] TERMINATING TOOL

[75] Inventor: Melvin P. Litehizer, Jr., Millersburg, Pa.

[73] Assignee: AMP Incorporated, Harrisburg, Pa.

[21] Appl. No.: 106,306

[22] Filed: Dec. 21, 1979

[51] Int. Cl.[3] ..... H01R 43/04

[52] U.S. Cl. ..... 29/751; 29/759; 29/760

[58] Field of Search ..... 29/751, 753, 759, 760

[56] References Cited

U.S. PATENT DOCUMENTS 3,742,571 7/1973 Brehm ..... 29/751 X 4,034,472 7/1977 Cover et al. ..... 29/753 X

*Primary Examiner*—Carl E. Hall

*Attorney, Agent, or Firm*—Allan B. Osborne

[57] ABSTRACT

The present invention relates to a hand held and hand actuated tool for terminating wires into terminals housed in a connector. More particularly, the invention includes an indexing system which advances the connector through a notch either before or after a wire is terminated therein. The indexing system employes a wheel which drives the connector and an indexing lever, operating off of the wire stuffing ram, which drives the wheel.

6 Claims, 7 Drawing Figures

Fig. 5A
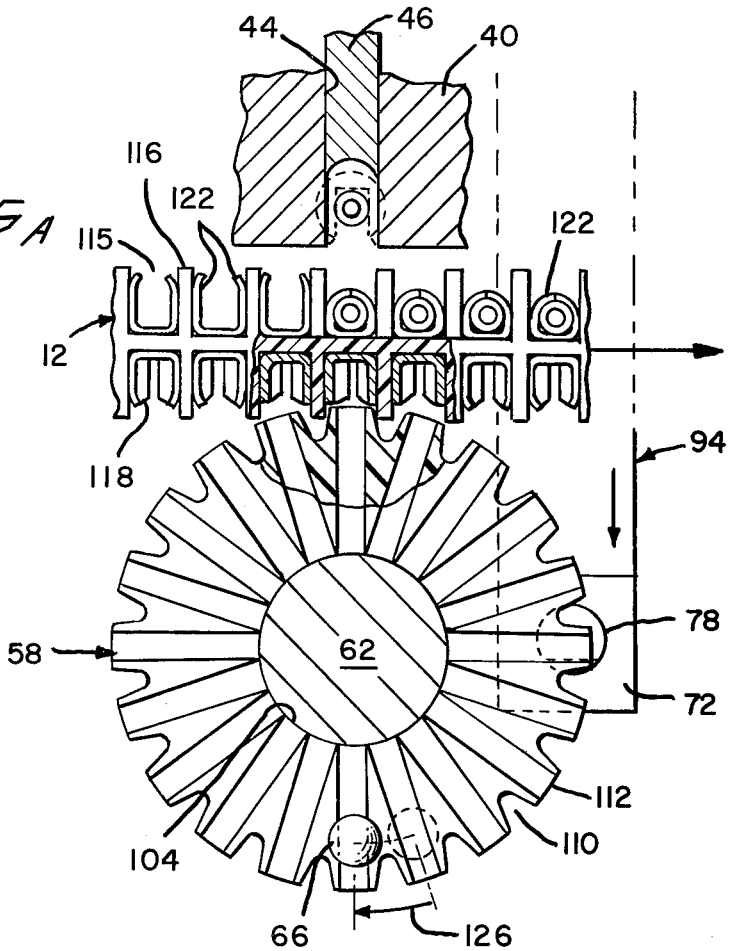
Fig. 5b
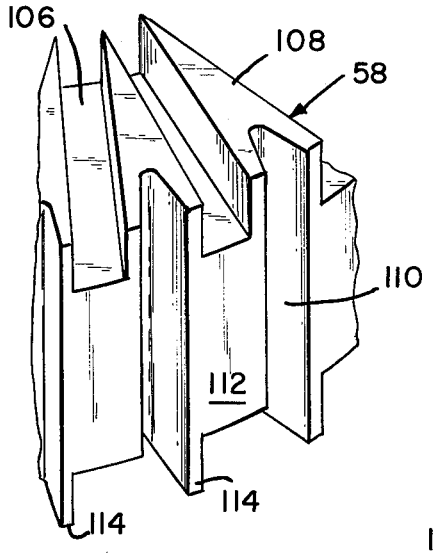
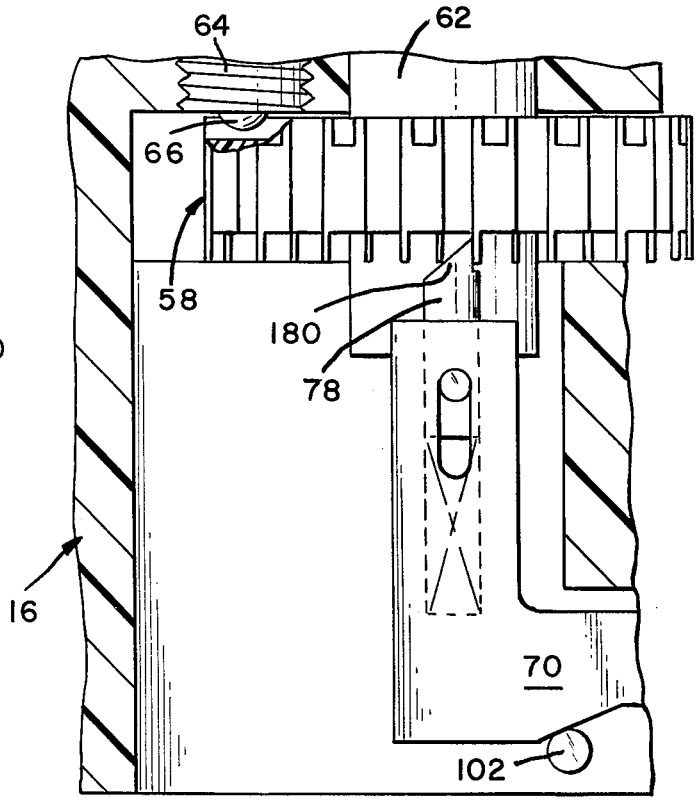
Fig. 6

TERMINATING TOOL

BACKGROUND OF THE INVENTION

1. Field of the Invention

This invention relates to hand tools of the type having an indexing means for advancing a connector through the terminating work area.

2. The Prior Art

There is no known art relating to hand tools having an indexing means which drive a connector through a notch and concurrently terminate wires in terminals having wire in slot blades.

SUMMARY OF THE INVENTION

The present invention includes a work frame in which is located an indexing wheel which has means thereon to engage and drive a connector through a notch in front of a wire stuffing device. The connector is of the type having a series of compartments or cavities containing terminals of the type having wire-in-slot blades and also insulation gripping arms. As the wire is terminated in one embodiment, the indexing means advances the connector to present the next cavity and terminal therein to the wire stuffing device. In another embodiment, the indexing means advances the connector immediately before the wire is terminated.

BRIEF DESCRIPTION OF THE DRAWINGS

FIGS. 5*a* and 5*b* are views showing parts of the work frame in greater detail; and FIG. 6 is a cross-sectional view in elevation showing an alternative indexing means.

DESCRIPTION OF THE INVENTION

Figure 1:
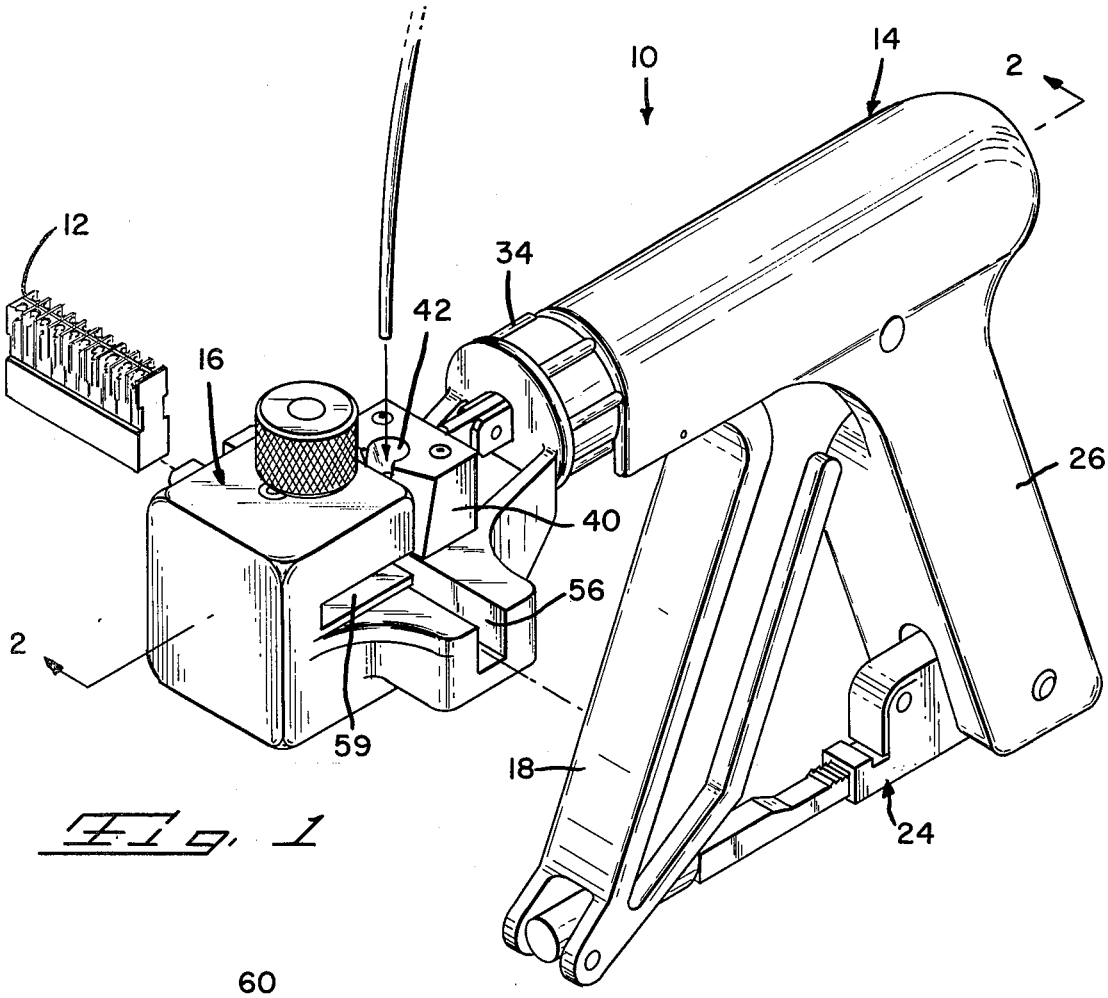
FIG. 1 is a perspective view of the tool of the present invention, and of the connector in which wires are terminated by the tool.

The invention disclosed herein is a hand-held and hand-actuated tool, designated generally by reference numeral 10, for terminating insulated wires into electrical connector 12 shown to the left of the tool in FIG. 1.

Figure 2:
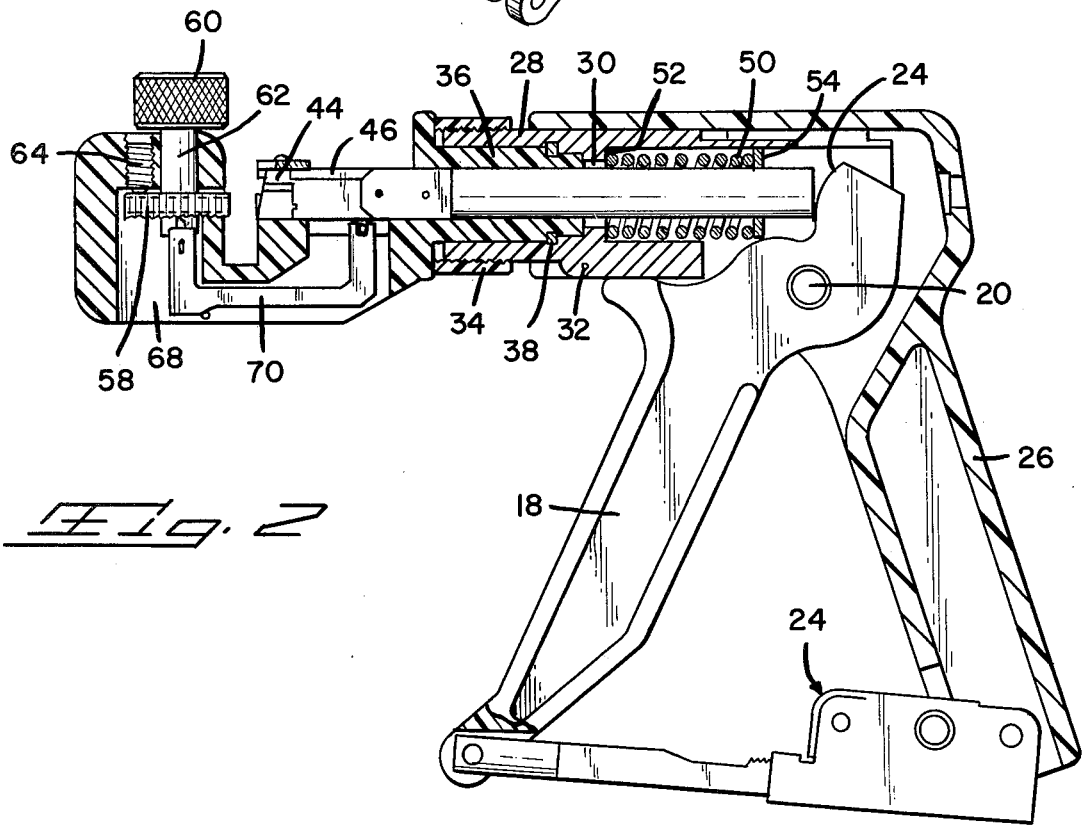
FIG. 2 is a cross-sectional view of the tool taken along lines 2—2 of FIG. 1.

With reference to both FIGS. 1 and 2, tool 10 includes two major, separable components; the handle 14 and the work section 16.

Handle 14 has an actuating lever 18 pivotally mounted by pin 20. The upper free end of the lever provides cam surface 22.

A conventional ratchet mechanism, indicated generally by reference numeral 24, is pivotally connected to the lower free end of lever 18 and to the free end of pistol grip 26.

The link which provides a means to removably join work station 16 to handle 14 is a generally cylindrical part 28 which has a passageway 30 extending longitudinally therethrough. This cylindrical part is fastened into the front end of handle 14 by pin 32. The front, outer surface of part 28 has threads onto which an adjusting collar 34, with mating internal threads, is positioned.

The work station frame 35 includes a cylindrical section 36 which extends rearwardly to be conformably received into passageway 30 and held in place by a U-shaped key 38 which is positioned in aligned grooves in the wall of passageway 30 and on section 36.

Frame 35 has a flat surface in front of section 36. Block 40 is located in the front part of this flat surface. A wire-receiving funnel shaped, vertical opening, designated by reference numeral 42, is provided in the block. Block 40 also includes a horizontal slot 44 running from front to back and which intersects opening 42. A wire stuffer, indicated by reference numeral 46 in FIG. 2, travels back and forth through slot 44 to stuff wires into terminals in connector 12. The stuffer is attached to reciprocating rod 48 which passes rearwardly through a passageway in cylindrical part 36, passageway 30 and abuts cam surface 24 on lever 18.

The rod is biased rearwardly against the cam surface by spring 50 which is compressed between a rearwardly facing shoulder 52 in passageway 30 and a pin 54 in the rod.

An upwardly open notch 56 cuts across frame 35 immediately in front of block 40. Connector 12 travels through this notch during wire termination.

Figure 4:
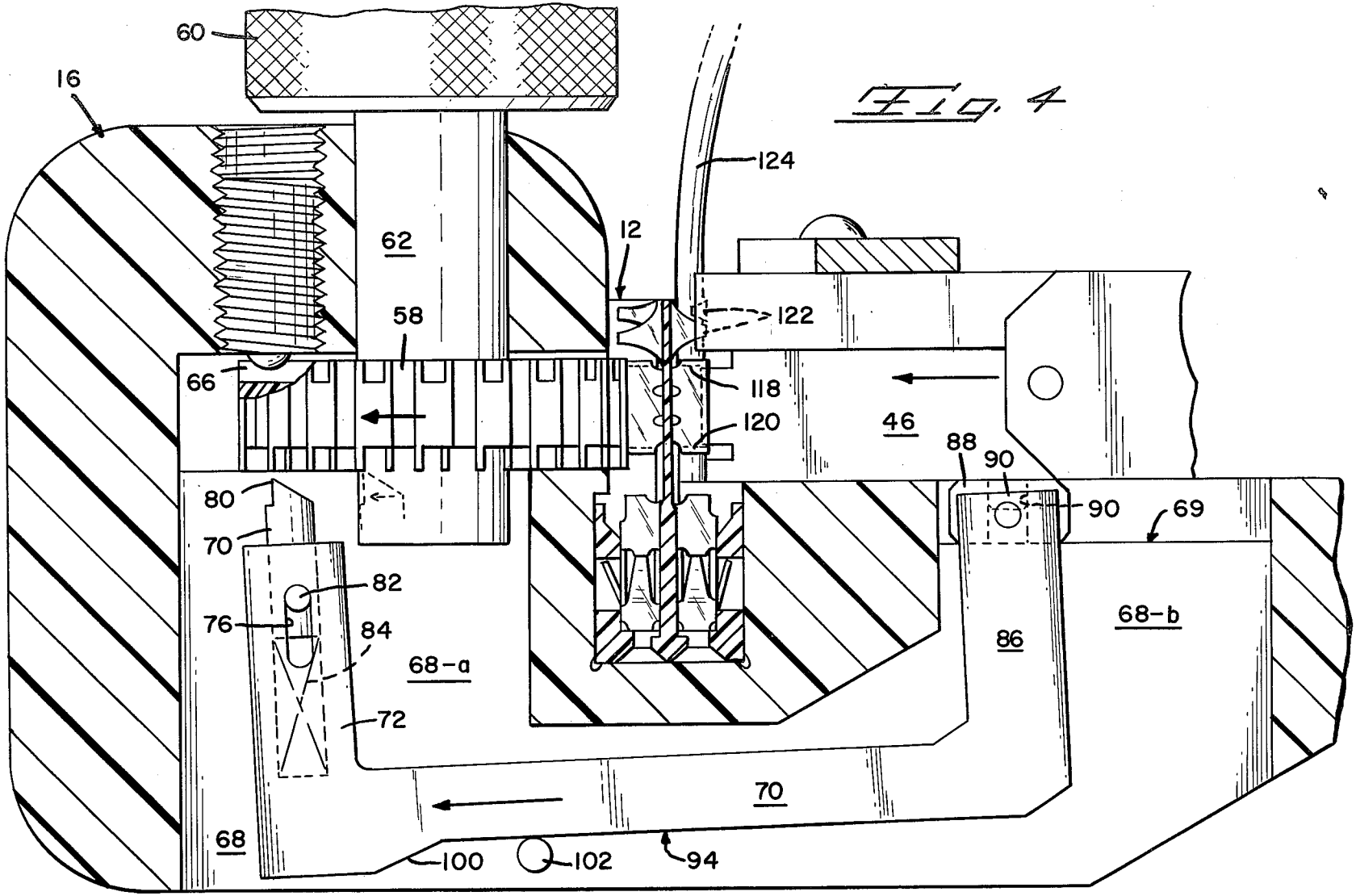

The front part of the work station frame houses a rotatable indexing wheel 58 located in a horizontal slot 59 (FIG. 1). The wheel is connected to a knob 60 by shaft 62. Additionally, a spring-biased ball assembly 64 is located in the front part with the ball 66 (FIG. 4) bearing against the upper surface of the indexing wheel.

Figure 3:
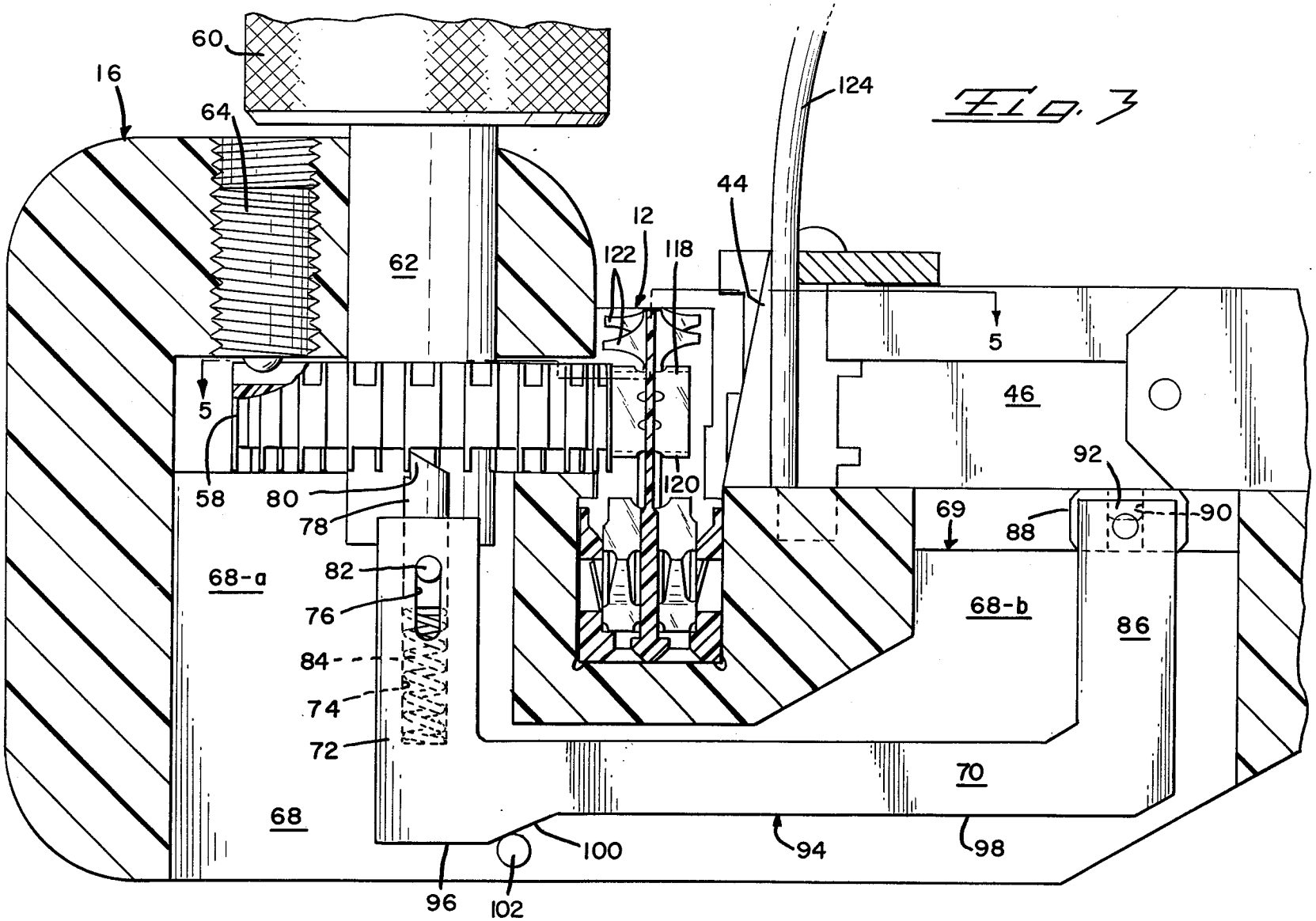
FIGS. 3 and 4 are cross-sectional views in elevation of the work frame portion of the tool of FIG. 4.

With reference to FIG. 3, one sees that a U-shaped cavity, generally indicated by reference numeral 68, is provided near one side and within the work station frame. This cavity extends almost completely along the length of frame 35 and opens out downwardly. One section of the opening, designated by reference numeral 68-*a*, extends upwardly to intersect horizontal slot 59 and the undersurface of wheel 58. The other section, designated by reference numeral 68-*b*, extends upwardly to a window 69 a little below wire stuffer 46. This window extends longitudinally from near the rear of the frame to block 40.

Preferably there is a second identical cavity (not shown) adjacent the other side of the frame for the purpose to be noted further on.

An indexing lever 70 is movably positioned in cavity 68. This lever is U-shaped with its forward arm 72 extending upwardly into section 68-*a*. This arm contains a bore 74 in the free end. An elongated slot 76, located below the top of the arm, intersects the bore. An indexing pin 78, slidably positioned in the bore engages the indexing wheel with a beveled tip 80. A stop pin 82, extends laterally from the indexing pin 78 into slot 76 to permit only limited vertical travel thereof. Coil spring 84 is positioned in the bore below indexing pin 78 so as to bias it upwardly against the indexing wheel.

The rearward arm 86 of lever 70 extends upwardly into section 68-*b*, and through the window. This arm is pivotally pinned to laterally extending finger 88 which underlies wire stuffer 46. The finger has a hole 90 which receives stud 92 which projects downwardly from stuffer 46. This connection results in moving lever 70 as the wire stuffer moves.

The lower surface 94 of indexing lever is divided into a lower forward section 96, a raised rearward section 98 and a connecting sloping section 100. The lever rides on pin 102 which is secured to the frame and extends across cavity 68.

Indexing wheel 58 is shown in detail in FIGS. 5-*a*, and 5-*b* to which reference will now be made.

Opening 104 extends vertically through the center of the wheel. Shaft 62 is received therein and secured thereto.

The top surface of the wheel has grooves 106 alternating with pie-shaped 108. The grooves and ribs radiate outwardly from the edge of opening 104.

The side of indexing wheel 58 has a plurality of vertical grooves 110. These grooves define vertical bars 112.

The undersurface of indexing wheel 58 is characterized by thin rails 114.

With continued reference to FIG. 5-*a*, the back of connector 12 is divided into a plurality of terminal-containing compartments 115 with walls 116 therein between (FIG. 5-*a*). The terminals include a pair of spaced wire-receiving, slotted blades 118 and 120 which are shown in phantom from one side in FIG. 3. One set of blades can be seen in FIG. 5-*a*. Insulation gripping arms 122 are located to the rear of the blades (FIGS. 3 and 5-*a*).

The operation of the above described hand tool will now be discussed.

In the embodiment described, indexing lever 70 is located on the right side of the frame. As positioned, the lever advances indexing wheel 58 clockwise. Accordingly, connector 12 is loaded into notch 56 on the right side. Pushing on the connector places it in position for terminating an insulated wire 124 in the terminal located in the first cavity facing rearwardly. However, this first compartment is not yet in alignment with slot 44 but rather is just to the right thereof. The end of wire 124 is now inserted into funnel opening 42 as shown in FIG. 3 to which further reference will be made. Actuating lever 18 is squeezed to drive the wire stuffer forward via cam surface 22 and rod 48. During the initial movement of the wire stuffer, etc., indexing lever 70 moves forward. The free end or tip 80 of indexing pin 78 baring on rail 114, advances or rotates indexing wheel 58 over a short distance; i.e., the distance from one upper surface groove 106 to the next groove 106 as shown by arrow 126 in FIG. 5-*a*. The downward force exerted on detent ball 66 by its associated spring, overridden by the initial rotational movement, pushes the ball into the next groove. Concurrently, the beveled section 100 on undersurface 94 of indexing lever 70 moves forward beyond pin 102 so that the forward arm 68-*a* of the lever drops down to effect a disengagement between the indexing wheel and the indexing pin. This action is shown in FIG. 1. The wheel cannot now move further because of the force exerted by the detent ball assembly 64.

During the rotation of the wheel, a vertical bar 112 enters the first, forwardly facing compartment in connector 12 and moves the connector left along notch 56 to where the first, rearwardly facing compartment is in direct alignment with slot 44 and wire stuffer 46. Continued pressure on the actuating lever drives wire stuffer 46 through slot 44 and pushes wire 124 into the wire-receiving slots in terminal blades 118 and 120. Concurrently next 128 on the wire stuffer contacts and wraps the two insulation gripping arms 122 about the wire.

Upon releasing the actuating lever, spring 50 returns the lever rod and wire stuffer to their original position. Lever 70 follows as it is attached to the stuffer. The beveled side of indexing pin's tip 80 rides back over the rails without moving wheel 58. At the end of its return travel, the tip is positioned behind a rail 114. Squeezing the actuating lever repeats the operation.

Knob 60 is provided to advance connector 12 through the notch to permit selective termination. The knob rotates wheel 58 (which moves the connector) without affecting any other tool action.

Turning now to FIG. 6, another embodiment of the indexing means is illustrated. The beveled tip 180 is facing towards the front of the work frame. Accordingly, as the indexing lever moves forward, the tip rides under rails 114 without moving the indexing wheel. As the lever 70 returns to its original position, however, (under the pressure of spring 50) the vertical straight side of indexing pin 78 abuts a rail 114 and the indexing wheel 58 is rotated over the predetermined circular distance.

This second embodiment of the indexing means causes the connector to move after the wire is stuffed into the terminal rather than just before. The operation of the tool is not changed otherwise.

As is obvious to the reader, wheel 58 will rotate counterclockwise with lever 70 on the frame's left side and clockwise with it located on the right side. This is, of course, simply a preferential choice to the user. It in no way affects the operation of the tool.

The tool disclosed and described above is hand actuated. It should be noted, however, that only minor changes would be required to employ hydraulics or air pressure to drive the ram. Such changes would be to handle 14 and would not require changes to work section 16.

It is to be understood that the forms of the invention shown and described herein are but preferred embodiments thereof and that various changes and modifications can be made therein without departing from the spirit or scope of the invention.

What is claimed is:

1. A hand tool for crimping wires into a connector of the type having a row of cavities on each side and with terminals of the type having wire-receiving slotted blades being positioned in the cavities, said tool comprising:

a. a piston-shaped handle having a movable shaft and means for moving the shaft back and forth;

b. wire stuffer means attached to the forward end of the shaft for stuffing wires into the wire-receiving slotted blades in the terminals;

c. a work frame attached to the front end of the handle and having a transversely-extending, connector-receiving notch, a block positioned immediately behind the notch and having a longitudinally extending slot through which the wire stuffer means moves and also having wire guide means on the side facing the notch and which intersects the slot so that as the wire stuffer means moves forwardly through the slot it picks up a wire which may be in the guide means and moves it into the slotted blades in a terminal in a connector which may be in the notch, said frame further having an indexing wheel rotatably positioned in front of the notch, said wheel having means thereon adapted to engage a connector which may be in the notch; and d. indexing means connected to the wire stuffer means at one end and engageable with the indexing wheel at the other end so that as the wire stuffer means moves, it moves the indexing means which engages and rotates the indexing wheel which in turn engages and advances a connector which may be in the notch so as to position a terminal in front of the longitudinally extending slot.

2. The hand tool of claim 1 further including spring-biased detent means located on the work frame for retaining the indexing wheel against inadvertent movement.

3. The hand tool of claim 2 further including a shaft and knob attached to the indexing wheel for the purpose of moving the connector via the indexing wheel through the notch independent of the indexing means.

4. The hand tool of claim 3 wherein the indexing means includes a U-shaped member with the rear upright arm being attached to the wire stuffer means and the front upright arm being engageable with the indexing wheel.

5. The hand tool of claim 4 wherein the lower surface of the bight of the U-shaped member comprises a forward and rearward section with one section being displaced vertically upwardly with respect to the other section and the two sections being connected by a sloping section and further with the rear upright arm being pivotally connected to the wire stuffer means.

6. The hand tool of claim 5 further including a pin secured to the work frame and on which the lower surface of the U-shaped member rides so that as the member moves back and forth on the pin, the front upright arm moves up and down and thusly in and out of engagement with the indexing wheel.

* * * * *